US007296610B2

(12) United States Patent
Zaluzec et al.

(10) Patent No.: US 7,296,610 B2
(45) Date of Patent: Nov. 20, 2007

(54) METHOD OF MANUFACTURING METALLIC COMPONENTS

(75) Inventors: Matthew Zaluzec, Canton, MI (US); David Cook, Northville, MI (US); Ulrich Weiss, Vaals (NL); Maik Broda, Eschweiler (DE); Clemens Verpoort, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 525 days.

(21) Appl. No.: 10/800,544

(22) Filed: Mar. 15, 2004

(65) Prior Publication Data

US 2006/0143896 A1 Jul. 6, 2006

(30) Foreign Application Priority Data

Mar. 13, 2003 (EP) ..... 03100640

(51) Int. Cl.
*B22D 19/04* (2006.01)
*B22D 19/08* (2006.01)

(52) U.S. Cl. ..... 164/100; 164/101

(58) Field of Classification Search ..... 164/100–102
See application file for complete search history.

(56) References Cited

U.S. PATENT DOCUMENTS

| | | | | |
|---|---|---|---|---|
| 3,565,300 A | | 2/1971 | Tamotsu et al. | |
| 4,953,612 A | * | 9/1990 | Sare et al. | 164/102 |
| 5,429,173 A | * | 7/1995 | Wang et al. | 164/75 |
| 6,221,504 B1 | | 4/2001 | Gasthuber et al. | |
| 2002/0069998 A1 | | 6/2002 | Jianzhong et al. | |

FOREIGN PATENT DOCUMENTS

| | | |
|---|---|---|
| DE | 101 13 962 A | 2/1991 |
| EP | 0 353 480 A | 2/1990 |
| EP | 0 411 577 A | 2/1991 |
| EP | 0 427 389 A | 5/1991 |

OTHER PUBLICATIONS

"A Dictionary of Metallurgy" by A.D. Merriman, MacDonald & Evans, LTD, 1958, p. 22.*

* cited by examiner

*Primary Examiner*—Kuang Lin
(74) *Attorney, Agent, or Firm*—Raymond L. Coppiellie

(57) ABSTRACT

A method of manufacturing metallic components consisting of at least two different materials, one of them being an iron-based alloy and the other an aluminum-based alloy, and involving the steps of: depositing a metallic layer onto the body made from the iron-based alloy, said layer being an aluminum-based alloy, preferably based on Al—Si or Fe, placing the coated body in a casting mold and casting an aluminum-based alloy about the coated body. Prior to placing the body in the casting mold, the metallic layer of the body is sprayed and/or blasted with silicon powder and/or Borax ($Na_2B_4O_7$—$10H_2O$, hydrated sodium borate).

3 Claims, No Drawings

METHOD OF MANUFACTURING METALLIC COMPONENTS

BACKGROUND OF THE INVENTION

1. Field of the Invention

The invention relates to a method of manufacturing metallic components consisting of at least two different materials, one of them being an iron-based alloy and the other an aluminum-based alloy. More particularly, the present invention relates to a method of manufacturing metallic components including the steps of depositing a metallic layer onto a body made from the iron-based alloy, the layer being an aluminum-based alloy, preferably based on Al—Si or Fe, and placing the body in a casting mold and casting an aluminum-based alloy about the body.

2. Description of the Related Art

In order to meet both the tribological and the manufacturing requirements on internal combustion engines, and more specifically those placed on the system piston, piston ring and cylinder liner, wear-resistant bodies are cast in the engine block. Depending on the load, various materials may be combined. For reasons of weight, ease of production and specific properties, aluminum alloys are used for engine blocks. In those regions of the system piston, piston ring and cylinder liner that are subject to tribological conditions, by contrast, iron-base alloys are used. For example, the cylinder liner being cast in the engine block and the ring bearing are manufactured from iron-based alloys. Due to the different specific properties of the materials, establishing a mechanical or metallurgical bond between the materials has always been a problem. Both the dynamic and the thermal properties in the internal combustion engine place high demands on the bond.

The "Alfin" process described in DE 95 86 14 has long been known as a method of achieving a metallurgical bond between different alloys. In this process, an aluminum alloy, of a few hundredth of millimeters thick, is deposited onto an iron-containing cylinder liner, thus providing a connection by diffusive bonding. As the cylinder liner is cast-in, the casting material is bonded to the diffusion layer.

To increase the metallurgical bond between the iron-containing part and the aluminum layer deposited, the document DE 23 44 899 suggests depositing a flux onto the iron-containing core. Although this measure may promote diffusive bonding with the iron-containing core, it has no effect on the casting-in.

A problem with the bond between the layer created by the "Alfin" process and the cast-in aluminum alloy is that an oxide layer forms on the aluminum. The oxide layers of the aluminum have a very high melting point of about 2000° C., while most current aluminum alloys having melting temperatures below 1000° C.

In responding to this problem and to the aforementioned ones, DE 43 25 864 A1 suggests a method in which a layer of chromium is electroplated over the aluminum layer. Although a bond achieved, this method is susceptible to a greater number of barrier layers in which pores and bonding failures may arise. Another drawback is that an oxide layer forms on the layer of chromium which makes wetting more difficult.

It is the object of the present invention to overcome the drawbacks of prior art and to enhance the metallurgical bond between the components made from various materials.

SUMMARY OF THE INVENTION

In accordance with the invention, the solution to this object is achieved by providing a method of manufacturing a metallic component consisting of at least two different materials, one of them being an iron-based alloy and the other an aluminum-based alloy, and comprising the step of depositing a metallic layer onto the body made from the iron-based alloy, the metallic layer being an aluminum-based alloy, preferably based on Al—Si or Fe, to form a coated body, and the step of placing the coated body in a casting mold and casting an aluminum-based alloy about the coated body. The invention further includes the step of blasting silicon powder or Borax onto the metallic layer of the body made from the iron-based alloy prior to placing it in the casting mold.

The method of the present invention activates the surface of the liner by the blasting of silicon and/or Borax ($Na_2B_4O_7$-$10H_2O$, hydrated sodium borate) powder particles for improved bonding of the cylinder liner to the cylinder block material. It is especially advantageous if the size of the blasted particles is about 200 and 300 μm.

DETAILED DESCRIPTION OF THE PREFERRED EMBODIMENTS

The method of the present invention will be described with reference to an example describing a method of casting a cylinder liner in an engine block. The method of the present invention can be used in any of a number of other manufacturing processes as well. According to the present invention, prior to depositing the metallic layer, the exterior surface of the cylinder liner is processed in order to achieve the required surface quality. The metallic layer to be applied may be produced either by thermal spray application or by the "Alfin" process. The metallic layers of preference are AlSi or Fe-sprayed layers. Next, and prior to placing the coated cylinder liner body into the casting mold, the metallic layer is sprayed and/or blasted with silicon powder and/or Borax ($Na_2B_4O_7$-$10H_2O$, hydrated sodium borate). The preferred particle size of the Borax or silicon powder used ranges from 200 to 300 μm. The silicon and/or Borax particles adhere to the surface of the liner, i.e. on the AlSi or Fe sprayed layer. Next, the cylinder liner is placed in the casting mold and, upon completion thereof, the cylinder block is cast. Liquid aluminum is cast about the cylinder liners. As already described herein above, the deposited Si- and/or Borax particles provide enhanced adherence.

It is of course also possible to coat other components to activate the surfaces thereof. These may for example be valve seats, valve guides or bearing shells. In some cases, these components are cast in the aluminum cylinder blocks or aluminum cylinder heads. Prior to placing the parts in the casting mold, they are also sprayed and/or blasted with silicon powder and/or Borax ($Na_2B_4O_7$-$10H_2O$, hydrated sodium borate). Again, the advantage lies in the enhanced adhesion and, as a result thereof, in the improved heat dissipation. In the region of the cylinder head (valve seat and valve guide), the valve is also protected from overheating.

The blasting process of the present invention creates a mechanical bond with the cylinder liner material. This is applicable for pure gray cast iron cylinder liners as well as for gray cast iron cylinder liners with an outer coating like sprayed AlSi or iron. In both conditions, a mechanical bond between the blasted powder and the outer surface of the cylinder liner is the result. With the help of the silicon and/or Borax, the bond between the liner and the cylinder block can be improved. During the melting process, the added silicon reacts with the aluminum of the block material. That means that a strong mechanical bond is created. With the help of Borax, this process can be improved. The effect of adding Borax is that the oxide layer of the aluminum cylinder block will be destroyed. The oxide layer of the aluminum is the major obstacle in creating a good bond with other materials as well as with aluminum itself. The other positive effect of using Borax is the decrease in melting point of the material in the outer surface region. On the one hand, this effect destroys the oxide layer and on the other hand, the two materials can start to create a metallurgical bond earlier. The two components have more time to establish a very good bond.

While particular embodiments of the invention have been shown and described, numerous variations and alternate embodiments will occur to those skilled in the art. Accordingly, it is intended that the invention be limited only in terms of the appended claims.

The invention claimed is:

1. A method of manufacturing metallic components consisting of at least two different materials, one of them being an iron-based alloy and the other an aluminum-based alloy, comprising the steps of:

depositing a metallic layer onto a body made from the iron-based alloy, said metallic layer being an aluminum-based alloy, spraying the metallic layer with a single layer of silicon powder whereby the silicon powder adheres to the metallic layer; and placing the body in a casting mold and casting an aluminum-based alloy about the body whereby the silicon powder reacts with the aluminum-based alloy cast about the body.

2. The method of claim 1, wherein the particle size of the silicon powder ranges from 200 to 300 μm.

3. The method of claim 2, wherein the body made from the iron-based alloy is a gray cast iron cylinder liner for a piston of an internal combustion engine.

* * * * *